United States Patent [19]

Martwick

[11] Patent Number: 5,067,407

[45] Date of Patent: Nov. 26, 1991

[54] CASED TELESCOPED AMMUNITION ROUND

[75] Inventor: Wilford E. Martwick, Minneapolis, Minn.

[73] Assignee: Honeywell Inc., Minneapolis, Minn.

[21] Appl. No.: 524,617

[22] Filed: May 17, 1990

[51] Int. Cl.[5] ..... F42B 5/045

[52] U.S. Cl. ..... 102/434; 102/464; 102/469

[58] Field of Search ..... 102/430, 433, 434, 440, 102/443, 464, 465, 467, 468, 469, 470

[56] References Cited

U.S. PATENT DOCUMENTS

| | | | |
|---|---|---|---|
| 2,853,945 | 9/1958 | Stealy | 102/468 |
| 2,866,412 | 12/1958 | Meyer et al. | 102/434 |
| 3,009,394 | 11/1961 | Kamp et al. | 102/434 |
| 3,873,375 | 3/1975 | Bolen et al. | 102/468 |
| 4,041,868 | 8/1977 | Rayle et al. | 102/468 |
| 4,197,801 | 4/1980 | LaFeyer et al. | 102/434 |

FOREIGN PATENT DOCUMENTS

| | | | |
|---|---|---|---|
| 68701 | 5/1893 | Fed. Rep. of Germany | 102/469 |
| 3403525 | 8/1985 | Fed. Rep. of Germany | 102/464 |

*Primary Examiner*—Harold J. Tudor
*Attorney, Agent, or Firm*—William T. Udseth; Edward W. Hughes

[57] ABSTRACT

A cartridge case 68 for a cased telescoped ammunition round 10. Cartridge case 68 includes a spirally wrapped hollow cylindrical casing 12 fabricated from a thin sheet of spring tempered high carbon steel which partially unwinds at the time round 10 is fired from a gun, a rear seal 16, and a front seal 18. A control tube 20 is secured to rear seal 16 and a primer 26 is mounted in communication with the interior of control tube 20. Casing 12 has an axis of symmetry 14 which is also the axis of symmetry of round 10, and control tube 20. Seals 16, 18 each have side walls 42, 42' in which crimp grooves 50, 50' are formed. Each crimp groove includes a cam surface 52, 52. Rear and front portions 62, 64 of casing 12 are crimped into grooves 50, 50'. A projectile 22 provided with a booster piston 24 is mounted within round 10 with piston 24 being located within control tube 20. The main propellant charge 32 is positioned around control tube 20 and projectile 22, and a booster charge 28 is positioned within control tube 20. When round 10 is fired, axial growth of casing 12 forces portion 62, 64 to ride up cam surfaces 52, 52' expanding them, and the layers of casing 12 to partially unwind to accommodate the increase in circumference of casing 12. When the pressure within casing 68 returns to normal, portions 62, 64 act to retract end seals 16, 18 and the layers of casing rewind to return substantially to their there original dimensions.

4 Claims, 2 Drawing Sheets

FIG. 1
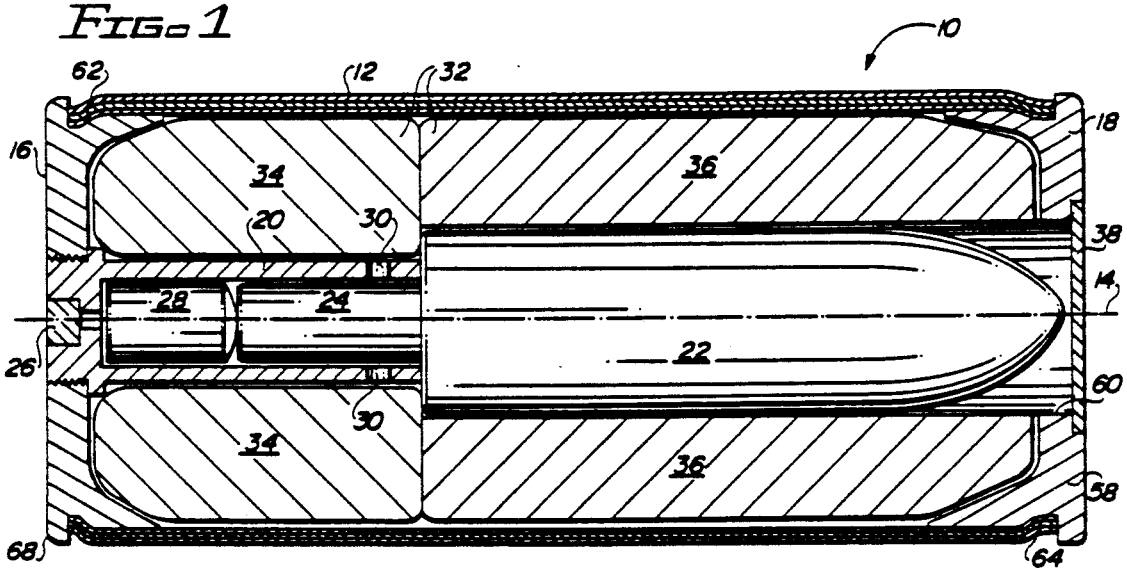
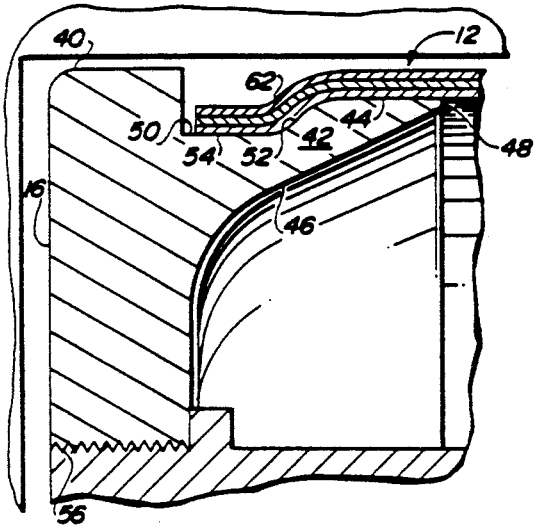
FIG. 2
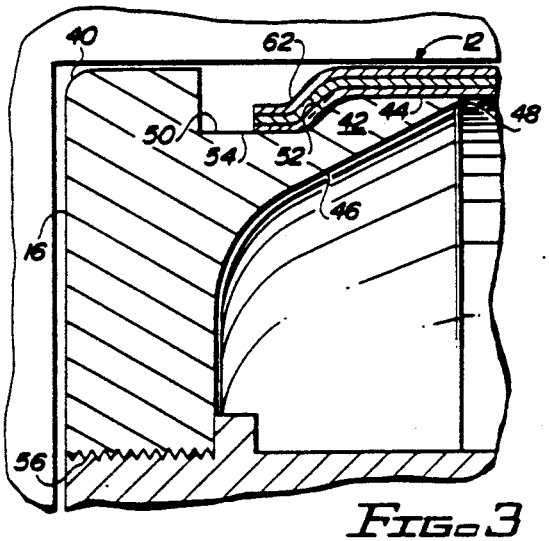
FIG. 3
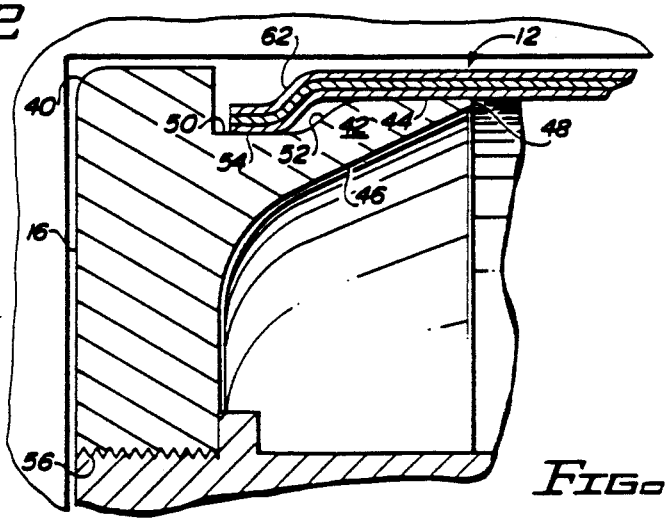
FIG. 4

CASED TELESCOPED AMMUNITION ROUND

BACKGROUND OF THE INVENTION (1) Field of the Invention

This invention is in the field of cased telescoped ammunition rounds, and more particularly relates to improvements to the cartridge case of such a round to facilitate removal of a fired cartridge case from the chamber particularly of a gun having a high rate of fire.

(2) Description of Related Art

Cased telescoped ammunition in which the projectile is completely enclosed, or telescoped, within the cartridge case, reduces the volume and weight of a gun system firing cased telescoped ammunition compared with the weight and volume of a gun system using conventionally shaped ammunition rounds having an equivalent rate of fire. The reduced weight and volume for equivalent fire power makes such gun systems desirable for mounting in aircraft, tanks, and other mobile combat vehicles. In this application a gun system is defined to include a gun and its associated ammunition storage and feed subsystems. The benefits of using cased telescoped ammunition in a gun system derive primarily from the cylindrical shape of the cartridge case of each such round.

When a cased telescoped ammunition round is fired, the projectile is initially accelerated by a booster charge to close, or to obturate, the barrel of the gun before the main propellant charge is ignited. A control tube is commonly used to control the initial movement of the projectile. A booster charge is located in the control tube and is separated by the tube from the main propellant charge. Products of the ignited booster charge are initially confined within the control tube by a booster piston attached to the base of the projectile. Main charge ignition does not occur until the advancing piston clears the tube, or exposes or unblocks, ignition ports in the wall of the control tube, which permits products of the burning booster charge to ignite the main charge. Ignition of the main charge is controlled by the position of the projectile and its booster piston relative to the control tube.

The external surfaces of the cartridge case of a typical cased telescoped ammunition round are formed by a cylindrical outer casing, or skin, and two caps, or end seals, a front seal and a rear seal. Each such round is loaded into a cylindrical gun chamber, or chamber, of the gun from which the round is to be fired, and from which the spent cartridge case is removed, or unloaded, after firing before another cycle of loading, firing and unloading begins. In guns from which such rounds are typically fired, the chamber housing in which a number of gun chambers may be formed can take the form of a cylinder which is rotated about its axis of symmetry similar to the rotation of the cylinder of a hand held revolver, for example. In such a gun system the rounds are mechanically loaded into a given gun chamber when that chamber has a given orientation, position, or station, relative to the gun barrel. The chamber housing is then rotated to bring the gun chamber into which a round has been loaded into alignment with the gun barrel ready for firing. After firing, the chamber housing is again rotated to another position so that the gun chamber with the cartridge case of the fired round, the spent cartridge case, can be removed from the gun chamber. Alternatively, the chamber housing may be moved linearly with respect to the gun barrel to position a gun chamber in a loading station where a round can be loaded into the chamber, the chamber housing is then moved to align the loaded gun chamber with the gun barrel. When the round is fired, the chamber housing is moved so that the gun chamber with the spent cartridge case is at its unloading station where the spent cartridge case is removed from the chamber prepatory to another round being loaded into it. In such a gun, the loading and unloading stations for a given chamber may be the same. Cased telescoped ammunition obviously can also be fired from more conventional guns firing projectiles of from 20 to 45 mm. for example.

When the interior of the cartridge case is pressurized by the burning of the propellant within the cartridge, the outer skin, or outer casing and the end seals function to prevent gun gas from escaping between the chamber housing and the breech and barrel faces of the gun. The pressure created by the burning propellant forces the end seals apart until they are constrained by the breech face of the gun forming one end of the gun chamber and by the barrel face of the gun barrel which forms the other end of the gun chamber. This pressure also forces the outer casing, or skin, of the cartridge case radially outward into intimate contact with the inner cylindrical surface of the gun chamber formed in the chamber housing. After such contact has been achieved, the pressure produced by the burning propellant acts to elastically deform the chamber housing, enlarging the diameter of the gun chamber and forcing apart the breech face and the barrel face of the gun. When the pressure within the cartridge case is relieved after the projectile exits the muzzle of the gun barrel, the gun and the chamber revert to their unpressurized dimensions. However, changes in the dimensions of the cartridge case experienced during firing can cause nonelastic changes in the dimensions of the cartridge case, so that the dimensions of the cartridge case do not return to the dimensions they possessed prior to the round being fired.

To extract a spent cartridge case after it has been fired, it is necessary in a gun with a movable chamber housings to move the chamber housing so that the gun chamber in which the spent cartridge case is located can be moved to its unloading position, or station. For such movement to take place as quickly as possible while requiring the minimum amount of force to accomplish such movement, it is necessary that there be sufficient clearance between the end seals of the spent cartridge and the breech face and the barrel face of the gun to minimize frictional resistance to the movement of the chamber housing. To quickly and easily remove the spent cartridge case from the gun chamber, it is important that the cartridge casing not press against the inner cylindrical surface of the gun chamber and that the spent cartridge case be sufficiently intact so that all components of the spent cartridge case can be removed together, or as an entity.

Because of the elastic deformation occurring in a gun firing cased telescoped ammunition is so large, there is a need for an improved cartridge case for a cased telescoped ammunition round that provides adequate and proper clearance between the end seals and the breech face and the barrel face of the gun after the round has been fired as well as between the cartridge casing and the surface of the gun chamber while maintaining the integrity of the spent cartridge casing to facilitate its removal.

To reduce the pressure exerted by the outer casing, or skin, of a spent cartridge case of such a round on the surface of the gun chamber within which the round is fired, and thus the force needed to remove the spent cartridge case, the skin, or outer casing, can be designed to split longitudinally when fired which minimizes any pressure exerted by the outer casing against the inner surfaces of the gun chamber after the gun chamber returns to its initial dimensions, the dimensions it had immediately prior to the round being fired. In such rounds the end seals are free to move relative to the outer casing which requires special means to maintain the integrity of the casing i.e., the necessary degree of connection between the end seals and the split casing so that they can be removed as a single entity. Typically, the joint between the end seals and the casing includes a sealant to prevent moisture and contaminants from entering the round, but such joints are not strong enough to maintain the integrity of a spent cartridge case with the degree of reliability required so that the requirement for removing a spent cartridge case as a single entity quickly, completely, and with a minimum amount of energy is not consistently satisfied.

SUMMARY OF THE INVENTION

The present invention provides an improved cartridge case for a cased telescoped ammunition round. The cartridge case of the round has a spirally wrapped hollow cylindrical outer casing the axis of which is also the axis of symmetry of the round, front and rear seals, a control tube and an igniter. The outer casing is fabricated from a thin sheet of spring tempered high carbon steel which is rolled to form a spirally wrapped hollow cylinder. The diameter of the outer casing increases as the spirally wrapped layers of the outer casing unwind, or slip relative to one another when the round is fired. The front and rear seals each have a base and an annular side wall formed integrally with its base. The side wall of each seal has a cylindrical outer surface and an outwardly tapering inner wall. The side wall of each seal terminates in a lip. An annular crimp groove is formed in the outer surface of the side wall of each seal near its base. A wall of each groove nearest the lip forms a cam surface. Each crimp groove has a bottom wall surface substantially parallel to the outer surface of the seal. A front portion of the outer casing fits over side wall of the front seal and is crimped into the crimp groove of the front seal with the inner surface of the outer casing in substantial contact with the cam surface and the bottom wall surface of the crimp groove. The rear portion of the outer casing fits over the side wall of the rear seal and is crimped into the crimp groove of the rear seal with the inner surface of the outer casing in substantial contact with the cam surface and the bottom wall surface of the crimp groove of the rear seal. A hollow cylindrical control tube is attached to the rear seal so that the control tube is symmetric with the axis of symmetry of the round. A projectile which has a booster piston secured to its base is positioned in the cartridge case with the booster piston located in the control tube. A booster propellant is positioned within the control tube between the primer, or igniter, and the free end of the booster piston. The primer which ignites the booster propellant is mounted in the rear of the control portion of the control tube. The main propellant charge is positioned around the control tube and the projectile, within the outer casing, and between the front and rear seals.

Since the layers of the spirally wrapped outer casing are not secured to each other, the layers partially unwind as the pressure of the gases produced by the burning propellant increase until interlayer friction prevents further unwinding. As the pressure increases beyond this level, the case wall layers act as a solid wall, and their level of stress increases to the yield point of the case material.

As the pressure decreases after firing, the case diameter contracts until the tensile stress in the material falls to near zero, and as the interlayer friction is reduced, the layers slide on one another as the layers of the casing rewind. The effect of these two phenomena is to reduce the diameter of the case to a value less than the diameter of the unpressurized chamber; thus, providing clearance to allow easy extraction of the case.

Axial growth of the casing which occurs as the pressure within the cartridge case increases when the round is fired. This pressure forces apart the front and rear seals of the cartridge case and causes the portions of the outer casing crimped into the crimp grooves of the front and rear seals to expand as these portions ride up the cam surface of each seal. When the pressure acting on the cartridge case returns to normal values after the round is fired, the smaller diameter of the crimp area tries to return to a zero stress condition. The resultant diameter reduction acts on the cam surfaces of the end caps to retract the end caps. In addition, the end caps are free at this time to move inward when subjected to a very low force until the ends of the case skin abut the outer ends of the crimp grooves which limits further inward movement of the end caps. Thus, no significant resistance is provided by the outer casing pressing against the wall of the chamber housing when the spent round is removed from the chamber, and none is present to oppose movement of the chamber housing relative to the barrel face and breech face of the gun from which the round was fired.

The only connection between the end seals, or the end caps, is provided by the outer casing. The connection between the outer casing and the end seals to which the outer casing is crimped is sufficient to maintain the integrity of the spent cartridge case so that it can be removed as an entity from the gun chamber from which the round was fired.

It is, therefore, an object of this invention to provide an improved cartridge case for a cased telescoped ammunition round in which the only connection between the front and rear seals of the cartridge case is provided by the outer casing of the cartridge case.

It is another object of this invention to provide a cartridge case for a cased telescoped ammunition round that facilitates removal of the cartridge case from the gun chamber from which the round was fired.

It is yet another object of this invention to provide a cartridge case for a cased telescoped ammunition round in which the outer casing of the cartridge case is fabricated of several spirally wrapped layers of a resilient material which layers unwind to a limited degree when the round is fired and in which the end seals are retracted after a round is fired by action of the portions of the outer casing crimped into crimp grooves of the seals acting on cam surfaces of the grooves.

BRIEF DESCRIPTION OF THE DRAWINGS

Other objects, features and advantages of the invention will be readily apparent from the following description of a preferred embodiment thereof, taken in conjunction with the accompanying drawings, although variations and modifications may be affected without departing from the spirit and scope of the novel concepts of the disclosure, and in which:

FIG. 1 is a section of a cased telescoped ammunition round case embodying this invention.

FIG. 2 is an enlarged fragmented sectional view of an end seal and of a portion of the outer casing which is crimped into the crimp groove of the seal prior to a round being fired.

FIG. 3 is an enlarged fragmented sectional view similar to FIG. 2 showing axial displacement of the outer casing relative to an end seal when the pressure of the burning propellant of the round is at its maximum.

FIG. 4 is an enlarged fragmented sectional view similar to FIG. 2 showing the position of the crimped portion of the outer casing relative to the crimp groove of an end seal after the round has been fired.

DETAILED DESCRIPTION

Figure 5:
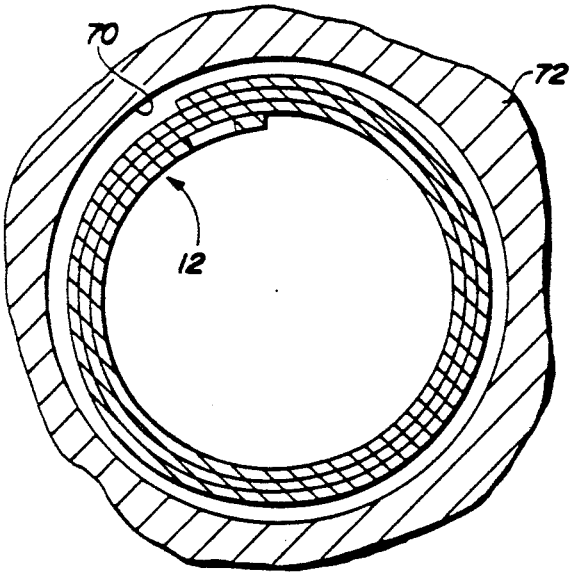
FIG. 5 is a sectional view taken on line 5—5 of FIG. 1 showing the positions of the layers of the spirally wrapped outer casing prior to the round being fired.

In FIG. 1 cased telescoped ammunition round 10 includes an outer casing, or skin, 12. Outer casing 12 is formed by rolling a sheet of thin spring tempered high carbon steel substantially into a right circular hollow cylinder having from 2 to 5 layers. Axis 14 of round 10 is the axis of symmetry, or longitudinal axis, of casing 12. Rear seal 16 closes off the rear end of casing 12, and front seal 18 closes off the front end of casing 12. Control tube 20 is also a right circular hollow cylinder one end of which is secured to rear seal 16 so that the axis of symmetry, or longitudinal axis of control tube 20 substantially coincides with axis 14.

Projectile 22 is provided with a booster piston 24, which is mounted on the base of projectile 22. When round 10 is assembled, booster piston 24 is positioned within a portion of control tube 20. Primer, or igniter, 26 is mounted in the rear end of control tube 20, and booster charge 28 is positioned within control tube 20 between booster piston 24 and igniter 26. Ignition ports, or vents, 30 are formed through the side walls of control tube 20. Vents 30 are initially blocked, or closed, by booster piston 24. Two segments of the main propellant 32 of round 10, rear segment 34 and front segment 36 are positioned around control tube 20 and projectile 22 within casing 12 and between end seals 16 and 18. Segments 34, 36 are formed by consolidating propellant grains. The inner diameter of front segment 36 is greater than that of rear segment 34 so that front segment 36 can fit around projectile 22. The central opening in front seal 18 is closed by environmental seal 38 which is made of a suitable material, such as aluminum foil. The function of seal 38 is to prevent elements of the environment external to round 10 such as moisture, dirt, etc. from entering round 10 and adversely impacting the performance of the round.

In FIGS. 2, 3 and 4 details of end seals 16, 18, particularly with reference to rear seal 16 are illustrated. Rear seal 16 has a base 40 and an annular side wall 42. Side wall 42 has a cylindrical outer surface 44 and an outwardly tapering inner surface 46. Side wall 42 terminates in a thin lip 48. An annular crimp groove 50 is formed around the exterior of side wall 42. One wall of groove 50 defines a cam surface 52 which is tangent to the base 54 of groove 50 and to the outer surface 44 of side wall 42. Since in FIG. 2, 3, and 4, rear seal 16 is illustrated, it should be noted that the base 40 of rear seal 16 has a threaded opening 56 into which one end of control tube 20 is threaded as illustrated in FIG. 1.

Base 58 of front seal 18 differs from base 40 of rear seal 16 primarily by being provided with an opening 60 which is made large enough so that projectile 22 can pass through opening 60 without interference when round 10 is fired. Otherwise, front seal 18 is substantially the equivalent of rear seal 16. Hereafter, elements of front seal 18 which are the same as those of rear seal 16 will use the same reference number except for being primed.

Outer casing 12 is made from a thin sheet of spring tempered high carbon steel which is rolled into a cylinder having from two to five layers, for example. The sheet of material from which outer casing 12 is made has a thickness preferably in the range of from 0.002 to 0.005 inches. The rear and front portions 62, 64 of outer casing 12 are annealed so that these portions can be crimped into crimp grooves 50, 50′ of end seals 16, 18. When round 10 is assembled, the joints between seals 16, 18 and portions 62, 64 of casing 12 are environmentally sealed by a sealant such as a room temperature vulcanizing silicone which is not illustrated.

A significant feature of round 10 is that components such as rear seal 16, control tube 20 with primer 26 positioned in it, booster charge 28, projectile 22, booster piston 24 and segments 34, 36 of main propellant 32 can be assembled as a unit and slid into outer casing 12. Front seal 18 is inserted into the front end of casing 12 and then portions 62 and 64 of casing 12 are crimped into crimp grooves 50, 50′. Opening 60 in front seal 18 is closed by environmental seal 38 to complete the assembly of round 10.

In the typical gun system which is not illustrated, a round 10 is loaded into a gun chamber in a chamber housing of the gun. The chamber housing is moved to align the gun chamber containing round 10 with the gun barrel. The gun chamber is fully defined by a breech face, the inner cylindrical surface of the chamber housing, and the face of the gun barrel. Round 10 is fired by a mechanism in the breech of the gun which drives a firing pin into primer 26, or by discharging an electrical current through primer 26. Primer 26 when initiated ignites booster charge 28. Pressure of the gases released by burning booster charge 28 act on the exposed end of booster piston 24 to accelerate projectile 22 out of round 10 into the forcing cone of the gun barrel. As projectile 22 moves forward, booster piston 24 exposes, or unblocks, vents 30 in control tube 20 so that the ignition products produced by booster charge 28 ignite main propellant 32. Ignited propellant 32 produces gases having a very high pressure and temperature that act against seals 16, 18 and outer casing 12, as well as on projectile 22 to accelerate projectile 22 to a desired muzzle velocity as projectile 22 exits the gun barrel.

As the pressure of the gases, gun gas, produced by burning propellant 32 increases, the lips 48, 48′ of end seals 16, 18 expand against skin 12 to seal the ends of the gun chamber so that no hot gas produced by burning propellant 32 impinges on the wall of the gun chamber and no such gas can escape from the gun chamber between the chamber housing and the breech and barrel faces of the gun. The pressure of the gun gas forces end seals 16, 18 apart until they are constrained by the breech and barrel faces of the gun. This pressure also forces the outer casing 12 outwardly against the inner cylindrical surface of the chamber housing in which the gun chamber is formed. The initial increase in the circumference, or diameter, of outer casing 12 is accomplished by the layers of outer casing 12 slipping past each other, or unwinding. The final increase in diameter occurs after interlayer friction prevents further unwinding which raises the stress level in the layers of outer casing 12. After such contact has been established with the inner surface of the chamber housing and as the pressure of the gas within cartridge case 68 which includes casing 12 and end seals, or caps, 16, 18 approach its maximum, the magnitude of the pressure is sufficient to elastically deform the chamber housing, enlarging the diameter of the gun chamber as well as forcing apart the breech and barrel faces of the gun.

Axial growth of cartridge case 68 is accommodated by the action of the crimped end portions 62, 64 of casing 12 in crimp grooves 50, 50' of end caps 16, 18. In FIG. 2 the position of rear portion 62 in crimp groove 50 of rear end cap 16 is that occupied by it after round 10 is assembled and prior to round 10 being fired. It should be noted that the inner surface of the inner layer of portion 62 is in substantial contact with the base 54 and cam surface, or ramp, 52 of crimp groove 50 at this time.

As seals 16, 18 are forced apart by the pressure of the gases produced by burning propellant 32, portions 62, 64 of outer casing 12 increase in diameter as the layers of outer casing 12 partially unwind and are also forced to yield to accommodate the ramp, or cam surfaces, 52, 52' of crimp grooves 50, 50' of end caps 16, 18. FIG. 3 illustrates these changes at the time the pressure within cartridge case 68 is at its maximum.

After projectile 22 exits the muzzle of the barrel, the pressure within cartridge case 68 quickly decreases toward ambient at which time the gun and its chamber housing revert to their unpressurized dimensions. When the pressure within the cartridge case 68 returns to normal, or ambient, the residual stress in crimped portions 62, 64 of casing 12 acts to return to a zero stress level, or to return to a smaller diameter, which retracts end caps 16, 18 to an extent dependent on the shape, or design, of cam surfaces, or ramps, 52, 52'. In addition, it should be noted that end caps 16, 18 are free to move inward until the vertical surfaces of crimp groves 50 abut casing 12 which limits any further inward movement. FIG. 4 illustrates the relationship between crimped rear portion 62 of casing 12 and rear seal 16 after round 10 has been fired and the pressure within cartridge case 68 has returned to substantially ambient conditions at which time the dimensions of case 68 are less than those of the gun chamber from which round 10 was fired. Thus, there is no frictional force opposing movement of the chamber housing of the gun from which round 10 is fired caused by seal 16, and 18 pressing against the breech and barrel faces of the gun.

Figure 6:
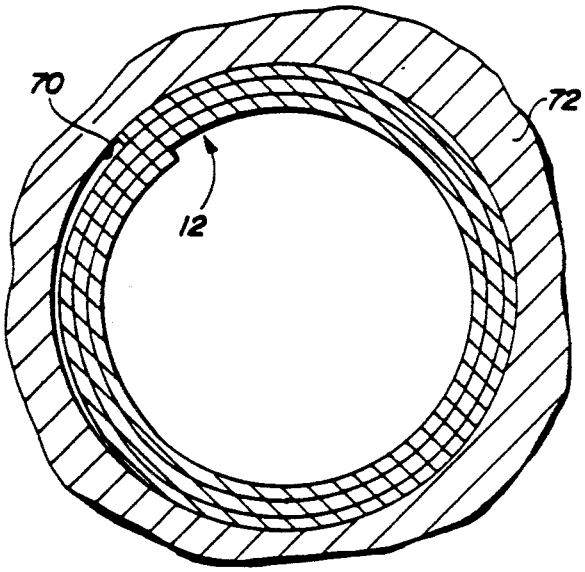
FIG. 6 is a sectional view similar to FIG. 5 showing the extent to which the layers of the spirally wrapped outer casing unwind and the circumference of the outer casing increases when the pressure within the cartridge case is at its maximum.
Figure 7:
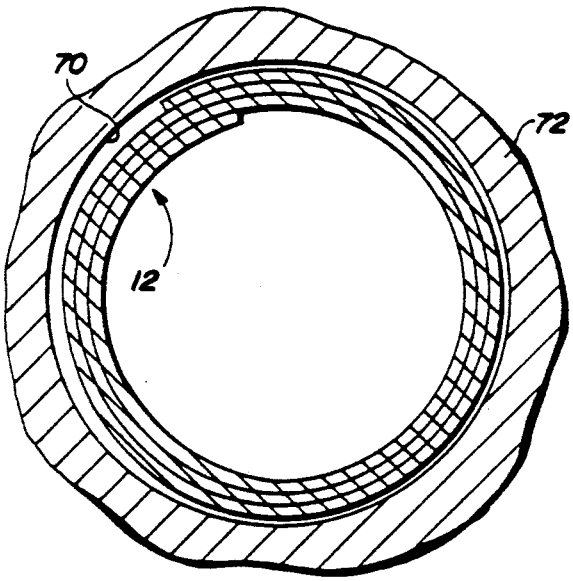
FIG. 7 is a sectional view similar to that of FIG. 5 showing the positions of the layers of the spirally wrapped outer casing after the round has been fired.

FIG. 5, is a section through outer casing 12 showing casing 12 positioned in cylindrical gun chamber 70 of chamber housing 72 of a gun from which round 10 is to be fired. The position of the layers of outer casing 12 relative each other and to the cylindrical surface of chamber housing 72 defining the gun chamber are those prior to round 10 being fired. In FIG. 6 the position of the spirally round layers of outer casing 12 is that assumed by these layers when the pressure within cartridge case 68 is at its maximum. As the pressure increases within cartridge case 68, the layers of outer casing 12 slide relative to one another to allow the diameter of outer casing 12 to increase. This slippage, or unwinding, continues until the pressure within cartridge case 68 is sufficiently large to exert a large enough compressive load on the layers of outer casing 12 so that friction between layers thereafter prevents their relative movement. The stress applied to the layers of outer casing 12 is, however, less than would be the case if the layers did not partially unwind which permits materials having a lower elastic limit to be used in forming outer casing 12 than would otherwise be required.

Upon release of the pressure with cartridge case 68 as projectile 22 exits the gun barrel, the layers of outer casing return toward to their original diameter and rewind. This provides an adequate clearance between outer casing 12 and the wall of chamber housing 72 defining gun chamber 70 within which round 10 is positioned when fired. Thus, no significant frictional force is created by casing 12 pressing against the surface of the gun chamber 70 to resist removal of cartridge case 68 after it is fired.

Because seals 16, and 18 are secured to casing 12 only by portions 62, 64 being crimped into crimp grooves 50, 50' of seals 16, 18, and because outer casing 12 remains intact after round 10 is fired, the integrity of the spent cartridge case 68 is maintained so that all the elements of spent cartridge case 68 can be removed as an entity from a gun chamber from which round 10 is fired and with a minimum expenditure of energy.

From the foregoing, it is readily apparent the present invention provide an improved cartridge case for a cased telescoped ammunition round that is easily assembled and provides positive length control. It should, therefore, be evident that various modification can be made to the described invention without departing from the scope of the present invention.

What is claimed is:

1. A cased telescoped ammunition round comprising:

a hollow cylindrical spirally wrapped outer casing having a rear portion, a front portion, an axis of symmetry, and a circumference, said outer casing being fabricated by rolling a thin sheet of spring tempered high carbon steel into a plurality of layers which partially unwind when the round is fired;

a rear seal;

a front seal;

the front seal and the rear seal each having a base, and an annular side wall integral with its base, the side walls having cylindrical outer surfaces, and outwardly tapering inner walls, the side walls terminating in lips;

annular crimp grooves formed in the outer surfaces of the side walls proximate the bases of the end seals, walls of the grooves nearest the lips forming cam surfaces, the crimp grooves each having having a base that is substantially parallel to the outer surface of the end seals and the cam surfaces of the crimp grooves being respectively tangent to both the bases of the crimp grooves and to the cylindrical outer walls of the front and rear seals;

the rear portion of the outer casing fitting over the side wall of the rear seal and being crimped into the crimp groove of the rear seal;

the front portion of the outer casing fitting over the side wall of the front seal and being crimped into crimp the groove of the front seal;

only the rear and front portions of the outer casing being annealed prior to to being crimped into the crimp grooves of the rear and front seals;

a hollow cylindrical control tube having a front end and a rear end, the rear end of the control tube being secured to the base of the rear seal so that the control tube is substantially symmetric to the axis of symmetry;

a projectile, at least a portion of the projectile fitting into the control tube;

a main propellant charge positioned around the control tube, within the casing and between the rear and front seals;

a booster propellant positioned within control tube; and primer means mounted in the control tube for igniting the booster charge and the main propellant charge when the primer means is initiated when the round is fired;

axial growth of the round occurring when the round is fired from a gun having a chamber housing forcing the portions of the outer casing crimped into the crimp grooves of the front and rear seals to ride up the cam surfaces of the seals expanding the diameter of the crimped portions of the outer casing, the stress induced in the expanded crimped portions of the outer casing retracting the end seals when the pressure of gases produced by the ignited main propellant charge within the round returns to ambient pressure; the circumference of the outer casing increasing as the layers of the outer casing unwind during firing, the circumference of the outer casing substantially returning to its initial value prior to being fired when the pressure within the outer casing returns to ambient pressure; and the pressure of gases produced by the ignited main propellant charge when the round is fired acting on side walls of the seals pressing the lips of the seals against the outer casing constrained by the chamber housing with sufficient force to prevent gas produced by the burning main propellant charge from escaping between the seals and the outer casing, the lips of the seals returning to the position occupied by each lip prior to the round being fired when the pressure within the outer casing returns to ambient pressure after the round is fired.

2. A cased telescoped ammunition round as set forth in claim 1 in which the thickness of the sheet of spring steel from which the outer casing is fabricated in in the range of from 0.002 to 0.005 inches and the number of layers is in the range of from two to five.

3. In a cartridge case for a cased telescoped ammunition round having a hollow cylindrical outer skin having a rear portion, and a front portion, a rear seal, a front seal, and an axis of symmetry; the improvements comprising:

fabricating the outer skin by rolling a thin sheet of spring tempered high carbon steel into a spirally wrapped cylinder having a plurality of layers;

the rear seal and the front seal each having a base and an annular side wall integral with its base, each side wall of the seals having a cylindrical outer surface and an outwardly tapering inner wall terminating in a lip, a crimp groove formed in the outer surface of the side wall of each seal, a wall of the crimp grooves of each seal nearest the lips forming a cam surface; the rear portion of the outer skin being crimped into the crimp groove of the rear seal and the front portion of the outer skin being crimped into the crimp groove of the front seal; only the front and rear portions of the outer skin being annealed prior to being crimped into the crimp grooves of the front and rear seals;

during firing of the round, the circumference of the outer skin increases as the layers of the outer skin unwind, the circumference of the outer skin substantially returning to its initial value prior to being fired when the pressure of the gases produced by the ignited main propellant charge acting on the outer skin returns to ambient pressure after the round is fired; and axial growth of the casing forcing the front and rear portions of the outer skin crimped into the crimp grooves of the front and rear seals to ride up the cam surfaces of said grooves, expanding the diameter of the crimped portions of the outer skin, the stress induced in the expanded crimped portions retracting the end seal when the pressure within the round returns to ambient.

4. A cased telescoped ammunition round as set forth in claim 3 in which the thickness of the sheet of spring steel from which the outer casing is fabricated in the range of from 0.002 to 0.005 inches and the number of layers is in the range of from two to five.

* * * * *